United States Patent [19]

Bolin

[11] 4,360,231

[45] Nov. 23, 1982

[54] BOTTLE CARRIER

[75] Inventor: James A. Bolin, Sapulpa, Okla.

[73] Assignee: Liberty Glass Company, Sapulpa, Okla.

[21] Appl. No.: 203,054

[22] Filed: Nov. 3, 1980

[51] Int. Cl.[3] ..... B65D 71/00

[52] U.S. Cl. ..... 294/87.2; 206/158; 206/430

[58] Field of Search ..... 294/87.2, 87 R, 87.26, 294/87.28; 206/151, 158, 199, 423, 430, 504, 821; 220/23.6, 23.8, 23.4

[56] References Cited

U.S. PATENT DOCUMENTS

| | | | |
|---|---|---|---|
| 3,003,805 | 10/1961 | Glazer | 206/162 |
| 3,036,853 | 5/1962 | Glazer | 294/87.2 |
| 3,527,345 | 9/1970 | Iorio | 206/65 |
| 3,587,846 | 6/1971 | Heier | 294/87.2 |
| 3,633,962 | 1/1973 | Erickson | 294/87.2 |
| 4,022,363 | 5/1973 | Eliassen | 294/87.2 |
| 4,095,720 | 6/1978 | Delbrouck et al. | 220/21 |
| 4,120,396 | 10/1978 | Mascia et al. | 206/430 |
| 4,159,841 | 6/1979 | Calvert | 294/87.2 |
| 4,192,540 | 3/1980 | Oliff | 294/87.2 |
| 4,235,468 | 11/1980 | Erickson | 294/87.2 |

*Primary Examiner*—James B. Morbert

*Attorney, Agent, or Firm*—Senniger, Powers, Leavitt and Roedel

[57] ABSTRACT

A bottle carrier having in an array on its upper side a plurality of bottle seats for receiving the bottoms of upright bottles held in a similar carrier thereabove. A set of bottle grippers is supported and centered relative to each seat by bottle gripper supports beneath the seat. Each set of bottle grippers releasably grips the neck of a bottle at the lower end of its finish, and is adapted for hanging the bottle by its finish with the upper end of the bottle below the seat and for supporting the carrier on the neck of the bottle. A set of bottles gripped by a carrier may be stacked on another set of bottles gripped by a carrier with the bottles of the upper set seated in the lower carrier's seats. For compact stacking of empty carriers, the bottle gripper supports are tapered to be received within central openings in the bottle seats.

19 Claims, 6 Drawing Figures

BOTTLE CARRIER

BACKGROUND OF THE INVENTION

This invention relates to bottle carriers, and more particularly to a molded plastic top-grip carrier for bottles, such as soft drink bottles.

The invention is especially concerned with a top-grip bottle carrier, i.e., a carrier which grips a plurality of bottles by the bottle necks, and is in the same general class as the carriers shown in U.S. Pat. Nos. 3,633,962, 4,159,841 and 4,192,540.

SUMMARY OF THE INVENTION

Among the several objects of this invention may be noted the provision of an improved top-grip carrier which enables stacking of sets of bottles (e.g., a set of six bottles) to greater heights with greater stability of the stack; the provision of such a carrier which promotes stacking of the sets of bottles one on top of another with each bottle of each set above the bottom set generally centered with respect to a bottle of the next set below and transmitting force via the carrier of the next set below to the bottle therebelow in such manner as to enhance stability; the provision of such a carrier adapted for ready application to grip bottles by their necks at the finish of the bottles, and adapted for ready release of the bottles; the provision of such a carrier which holds the bottles in such manner as to impede tampering with the bottle closures while the bottles are gripped by their necks in the carrier; the provision of such a carrier which provides protection for the bottle closures against damage such as might otherwise be caused by the closures being struck by the bottoms of bottles in stacking or other normal handling of the bottles; the provision of such a carrier which, within limits, is adapted to hold bottles of different diameters and different neck configurations; the provision of a construction for such a carrier which enables compact stacking of the carriers per se for shipment, storage and handling; and the provision of such a carrier which may be economically molded in one piece of plastic for use as a disposable carrier.

A carrier of this invention is constructed to carry bottles of the type having a neck and a finish at the bottle mouth, and is adapted to carry a plurality of such bottles grouped in a predetermined array by the bottle necks with the bottles hanging down from the carrier, and to enable relatively stable stacking of the bottles. Generally, the carrier comprises a plurality of bottle seats spaced in correspondence with the predetermined array, each for seating of the bottom of a bottle held by a carrier thereabove. Each seat has a central opening. A bottle gripper supporting means is provided beneath each seat. Each bottle gripper supporting means comprises a set of supporting members extending down from the respective seat at its boundary centered with respect to the seat, and inclined inwardly toward one another. Bottle gripper means, one for each seat, are provided, each carried at the lower end of the respective gripper support. Each gripper means comprises a ring at the lower end of the respective set of supporting members and resilient means on the ring adapted to be spaced apart by the upper end of a bottle entered upwardly through the ring and adapted and releasably to grip the neck of the bottle at the lower end of the finish for hanging of the bottle by the finish. The supporting members and resilient means are so dimensioned relative to the bottle finish that the mouth of a bottle carried by any of said resilient gripper means will not project above the respective seat. Thus, when a set of bottles gripped by a carrier is stacked upon another set of bottles gripped by a carrier, the bottles gripped by the upper carrier may be maintained in vertical alignment with the bottles gripped by the lower carrier by seating of the bottles gripped by the upper carrier in the seats of the lower carrier, to provide stability for the stack of bottles.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF THE PREFERRED EMBODIMENT

Figure 5:
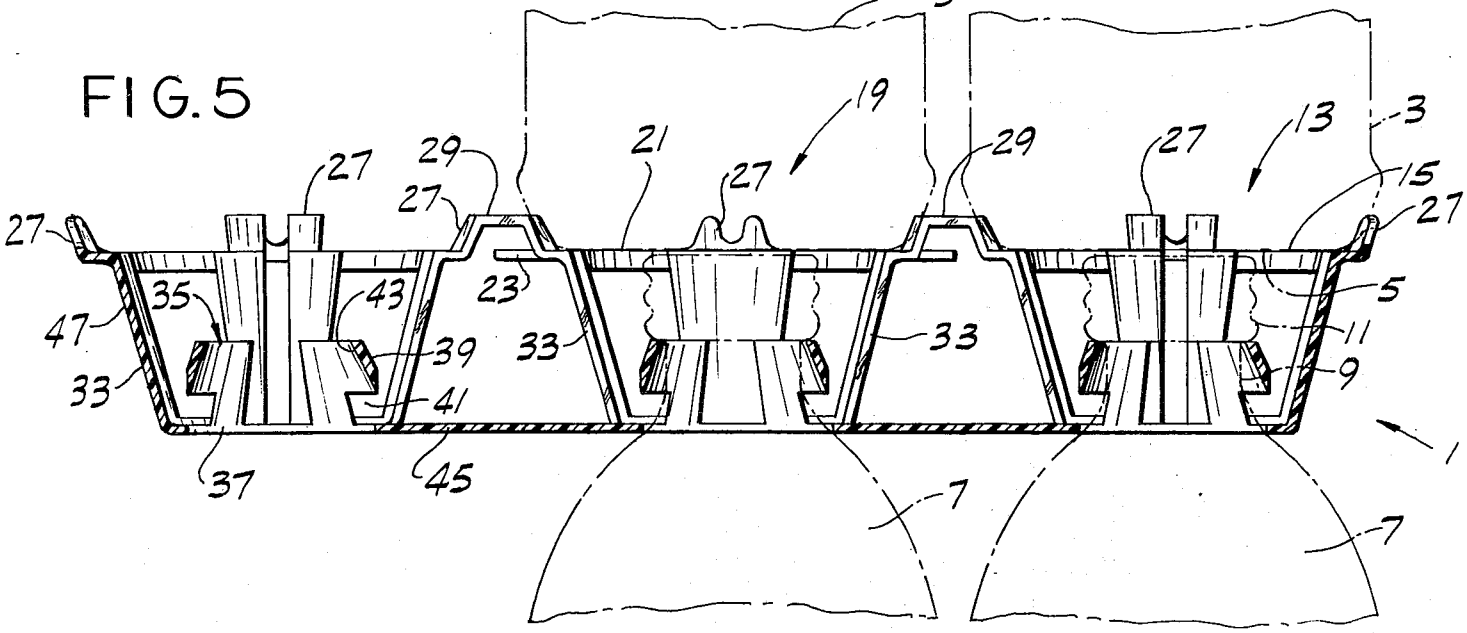
FIG. 5 is an enlarged section on line 4—4 of FIG. 1.
Figure 4:
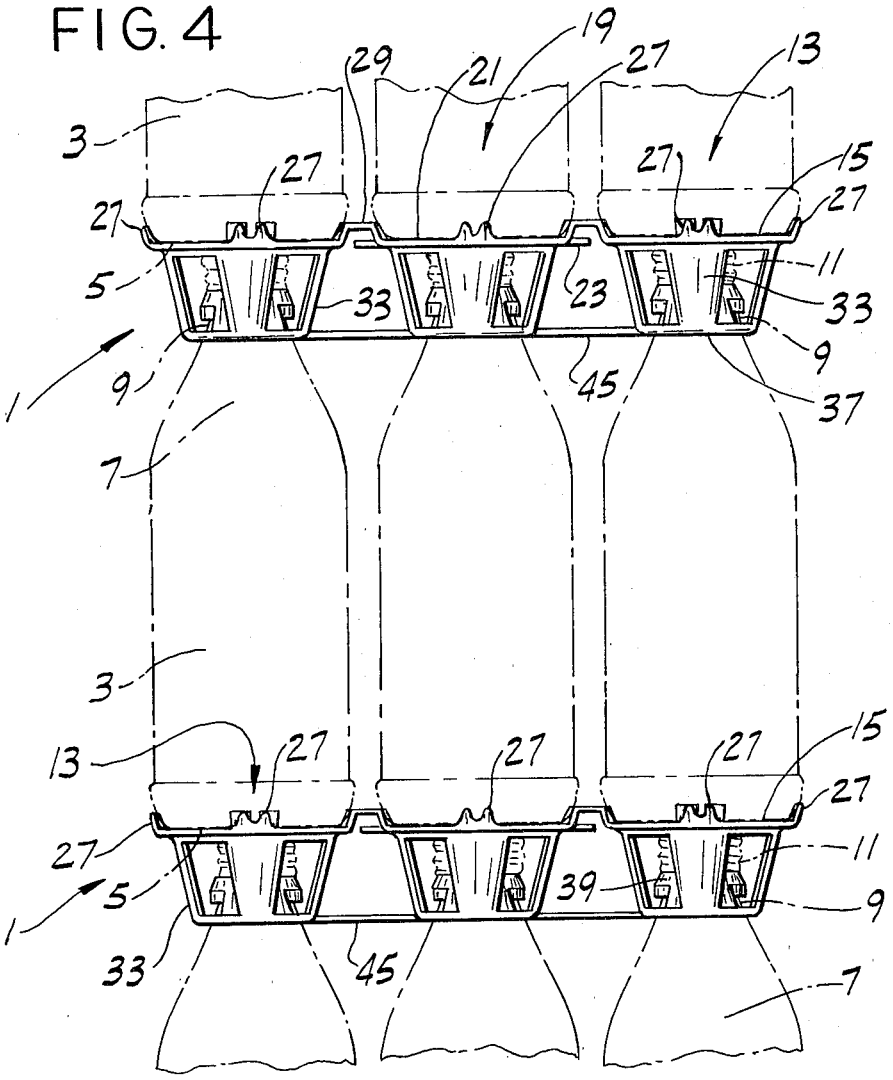
FIG. 4 is a side elevation of two sets of bottles gripped by bottle carriers stacked one on the other.

The accompanying drawings show the presently preferred embodiment of the bottle carrier of this invention, designated in its entirety at 1, which is of one-piece molded plastic (any suitable plastic such as polypropylene may be used) and is for use with bottles 3 such as filled soft drink bottles of the type shown in phantom lines in FIGS. 4 and 5 which are circular to provide a set or package of bottles. Each bottle carrier illustrated is adapted for six bottles in upright position grouped in a conventional array of two rows of three bottles each (a six-pack). The circular bottom of the bottle is designated 5. Each bottle has a tapered neck 7, and an annular ring or finish 9 at the bottle mouth, which is shown as threaded, with the bottle closed by a screw cap 11 threaded on the finish. Carrier 1 may be adapted for carrying bottles of the crown cap type, as will be evident from the following description.

Figure 1:
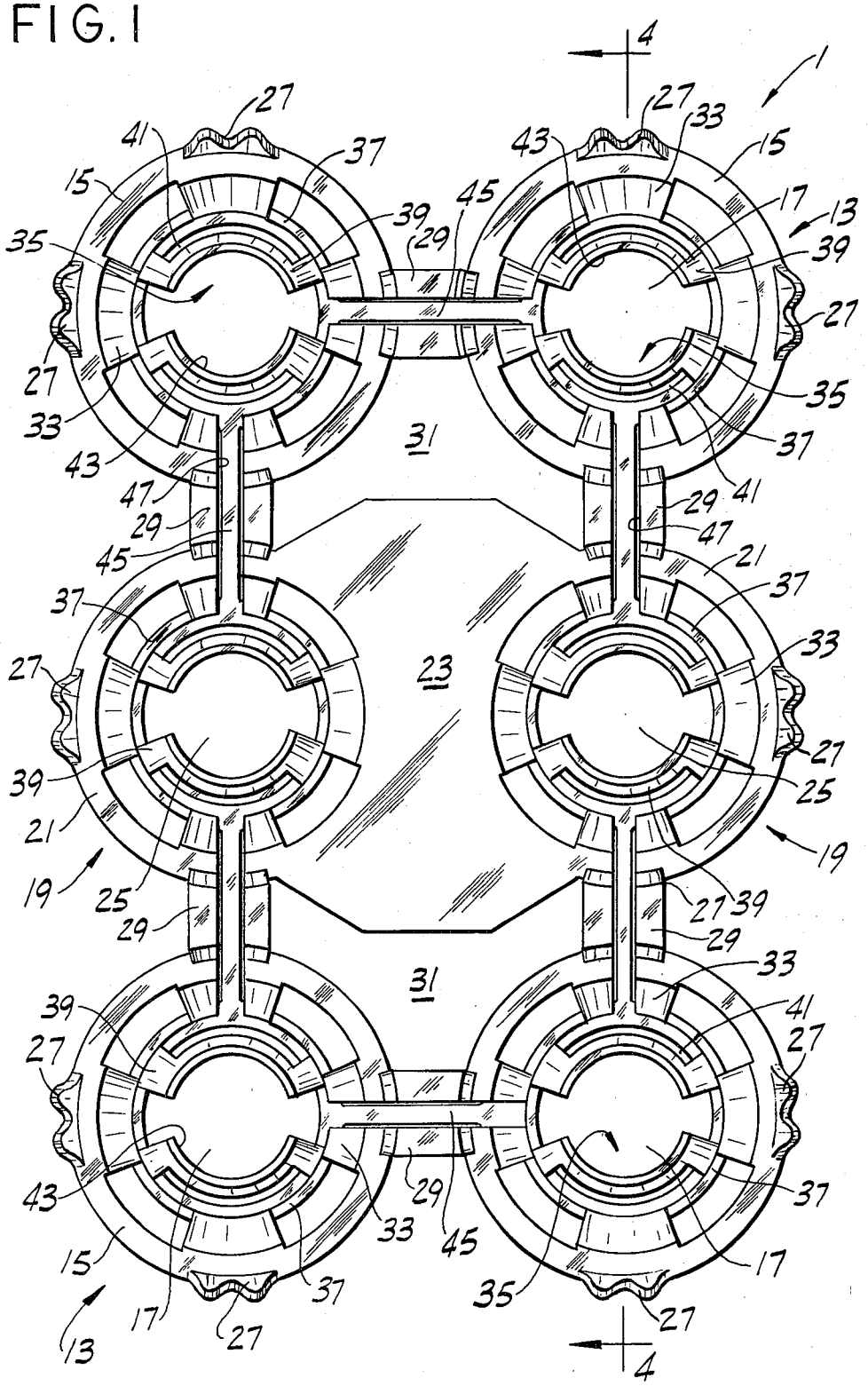
FIG. 1 is a plan view of a bottle carrier embodying the present invention.

The bottle carrier 1 includes six bottle seats, the six seats lying in a common plane in two rows of three seats each. Each of the four outer seats, generally designated 13, comprises an annular flat base 15, having a relatively large central circular opening 17, as shown in FIG. 1. The two center bottle seats, each generally designated 19, are formed together by two semicircular base portions 21 joined by a central plate portion 23 constituting a handle portion. Each of these two center seats 19 has a central circular opening 25 like the four outer seats 13.

Each bottle seat base 15, 21 has a circular series of lugs or teeth 27 spaced around the upper side of its outer edge providing what may be called a socket formation for cradling the bottom 5 of a bottle and holding the bottle seated on the base confined laterally by the lugs 27. The latter are positioned on the centerlines of each row of seats so that the lugs of adjacent bottle seats are back-to-back. Four lugs are provided on each of the four outer seats 13; the two center seats 19 have only three (no lugs being provided on the central plate 23).

The radially inner sides of the lugs are tapered outward and upward for bottle centering purposes.

As shown in FIG. 1, the bottle seats 13, 19 are spaced apart in the two-by-three array by the central plate 23, which joins the two center bottle seats 19 and by a plurality of web or bridge members 29 joining the upper ends of the back-to-back lugs 27 of adjacent bottle seats. Finger-receiving openings 31 are provided between the bridge members, central plate 23 and bottle seats 13, 19 through which the carrier may be grasped for carrying it (and the bottles gripped thereby), the central plate 23 serving as a handle.

Figure 3:
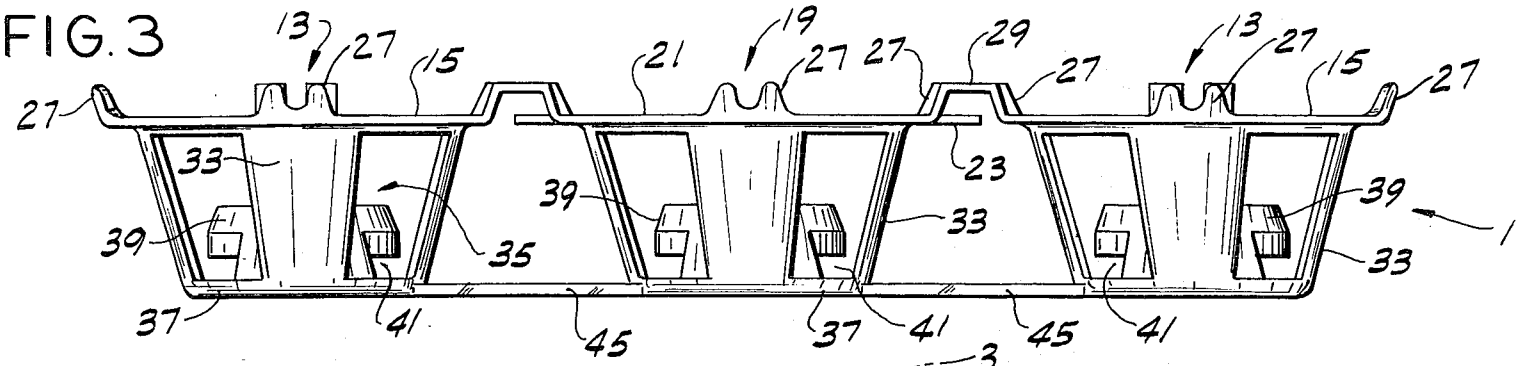
FIG. 3 is a side elevation of the bottle carrier.
Figure 6:
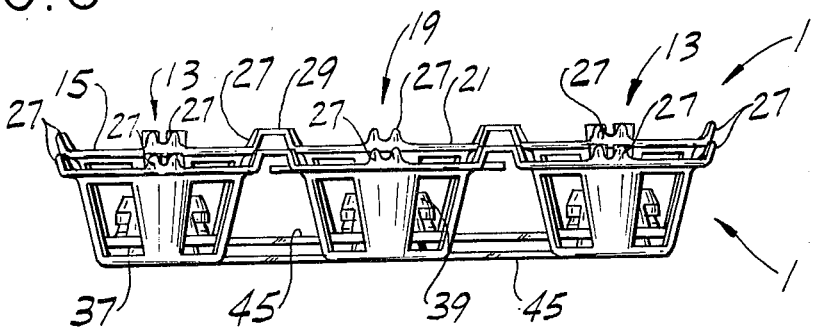
FIG. 6 is a side elevation showing two empty bottle carriers per se stacked together.

Bottle gripper supporting members as legs 33 extend down from the boundary of each seat from the bottom of the annular seat base 15, 21, as shown in FIGS. 3, 4 and 5. Each seat has four equally spaced apart supporting members as legs 33, which are centered with respect to the seat and in the preferred embodiment are beneath lugs 27. Each set of four legs is coned downward (i.e., the legs are enclosed inwwardly toward one another) around the central opening 17, 25 to a diameter which permits stacking of one empty carrier on another with the legs of one carrier extending through the central opening of and on the inner side of the legs of a second carrier, thereby enabling compact nested stacking of empty carriers, as shown in FIG. 6.

Figure 2:
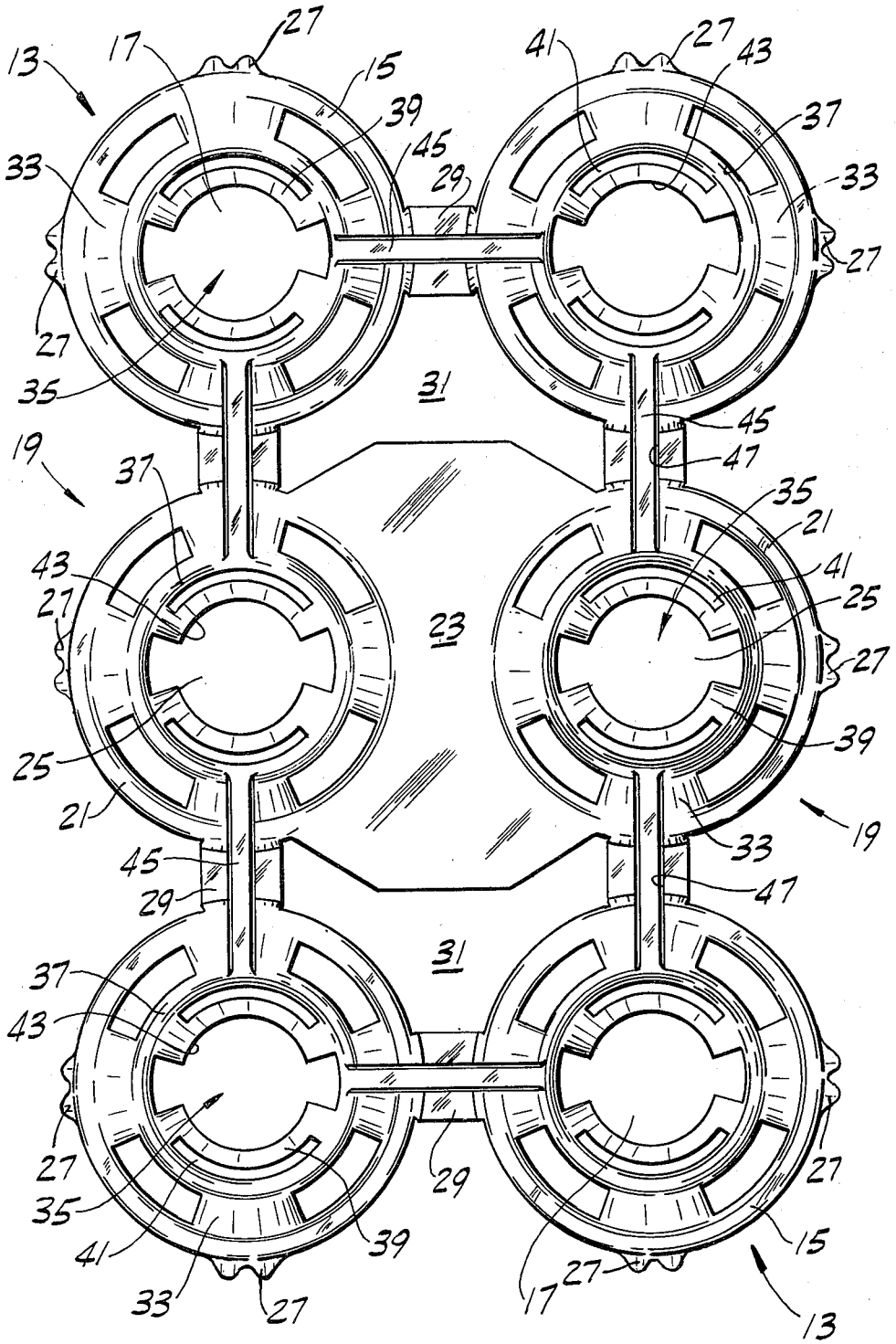
FIG. 2 is a bottom view of the bottle carrier.

The four legs 33 beneath each bottle seat carry a set of bottle grippers constituting a bottle gripper means generally designated 35 at their lower ends, each set of bottle grippers being constituted by a support ring 37 (see FIG. 2) joining the lower ends of the legs and a pair of arcuate resilient tongues 39 projecting upward and radially inward from the ring. As shown in FIGS. 3 and 5, each tongue has a rectangular opening 41 adjacent the ring 37 to increase its resiliency (and reduce the amount of plastic). The two tongues have arcuate upper ends 43 below the bottle seat defining a generally circular opening which accepts the upward entry of the upper end of the neck 7 of a bottle by radially outward deflection (spreading apart) of the tongues. When the bottle cap 11 and finish 9 of a bottle inserted upward into the set of grippers 35 has cleared the upper ends of the tongues, the tongues snap back (contract) into engagement with the neck of the bottle at the lower end of the finish to grip the neck for hanging the bottle by the finish, as shown in FIGS. 4 and 5. In the embodiment shown, the tongues support the bottle by abutting the lower side of bottle cap 11 at the bottom of the finish.

Each bottle gripper ring 37 has an inner diameter such that when a bottle is gripped by its neck with the resilient bottle gripper tongues 39 engaging the bottle neck at the lower end of the finish, the ring rests on the bottle in surrounding engagement with the bottle in a plane below the lower end of the bottle finish tending to stabilize the bottle against swaying or tilting relative to the carrier and supporting the weight borne by the carrier, as shown in FIGS. 4 and 5. The lengths of the bottle gripper support legs 33 and bottle gripper tongues 39 are so proportioned relative to the length of the portion of the bottle above the finish that a bottle carried by a set of grippers will not project above the bottle seat 13, 19 above it. Thus, the bottle seat may accommodate the bottom of a bottle above without interference from the top of a bottle below.

A bottle is removed from a carrier by sidewise movement of the bottle to spread apart the tongues 39 and thereby widen the opening between them so that the mouth of the bottle, with its cap 11, may be withdrawn through the opening.

Integrally molded struts 45 are provided extending beneath each of the bridge members 29 joining the bottle gripper rings 37 at the lower ends of legs 33 of adjacent bottle seats adding rigidity to the carrier. To permit compact stacking of two or more empty carriers, as shown in FIG. 6, slots are provided as indicated at 47 in each carrier's upper side in alignment with the struts 45 to receive the struts of an empty carrier stacked on it. Each slot extends through the bridge members 29, bottle seat lugs 27, annular bases 15, 21, and downward through the support legs 33, as shown in FIGS. 1 and 5. The bottle gripper rings 37 are not interrupted by the slots. As shown in FIG. 6, several empty bottle carriers (not carrying bottles) may be stacked in a compact group with the inwardly tapering support legs and bottle gripper tongues 35 of each bottle seat received within the central opening of the annular base 15, 21 and inwardly of the legs of the bottle seat beneath it. The upper carrier's tongues are inward of the lower carrier's tongues and the upper carrier's struts 45 are received in the lower carrier's corresponding slots 47. Such nested stacking of the empty carriers reduces the space required for storage and transport from the manufacturer to the bottling plant.

A major advantage of the bottle carrier 1 is in stacking of several sets or packs of bottles, that is, carriers carrying bottles, as shown in FIG. 4. When a first carrier 1 carrying six bottles (forming a six-pack) is supported upright, a second or upper six-pack may be stacked on the first pack with the bottles carried by the two carriers maintained in vertical alignment by seating of the upper carrier's bottles in the seats of the lower carrier. This provides stability to the stack of six-packs and may permit stacking of the packs higher than heretofore practical with conventional neck-grip carriers.

With the ring 37 at the lower end of the bottle gripper bearing on the neck of a bottle grasped thereby and with the mouth of the bottle below the bottle seat, as shown in FIG. 5, a bottle may be supported on a bottle seat and its weight transferred by the carrier below to the neck of the bottle below.

Since the bottle cap 11 is accommodated below the level of bottle seat base 15, 21 and encaged by the annular base and bottle gripper support legs 33, access to the cap of a bottle within the carrier is limited. This impedes tampering with the bottle cap, pilfering of the bottle's contents, and other damage to the cap which could otherwise be caused by being struck by another bottle.

The tapered bottle seat lugs 27 tend to aid in seating and centering the bottom of a bottle on the bottle seat base 15, 19 by camming the bottom of a descending off-center bottle into place generally centered on the seat. Where the bottle is slightly too large to bear directly on the flat base, it may be supported on the inner tapered portions of the lugs; thus the carrier may be used for bottles having bottoms of somewhat different diameters.

It will of course be understood that the bottle carrier may be modified to provide various predetermined arrays of bottles, such as an eight-pack having two rows of four bottles each.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A carrier for bottles, each of which has a neck and a finish at the bottle mouth, adapted for carrying a plurality of bottles grouped in a predetermined array by the bottle necks with the bottles hanging down from the carrier, and enabling relatively stable stacking of bottles, said carrier comprising:

a plurality of bottle seats each adapted for the seating therein of the bottom of a bottle held by a carrier thereabove, each seat having a central opening;

means for spacing the plurality of bottle seats in correspondence with said predetermined array;

bottle gripper supporting means beneath each seat, each supporting means comprising a set of supporting members extending down from the respective seat spaced around the seat, being centered with respect to the seat, and inclined inwardly toward one another; and a plurality of bottle gripper means, one for each seat, each comprising a ring at the lower end of the respective set of supporting members and resilient means on the ring adapted to be spread apart by the upper end of a bottle entered upwardly through the ring and adapted releasably to grip the neck of the bottle at the lower end of the finish for hanging of the bottle by the finish;

said supporting members and said resilient means being so dimensioned relative to the bottle finish that the mouth of a bottle carried by any of said resilient means will not project above the respective seat;

whereby when a set of bottles gripped by a carrier is stacked upon another set of bottles gripped by a carrier, the bottles gripped by the upper carrier may be maintained substantially in vertical alignment with the bottles gripped by the lower carrier by seating of the bottles gripped by the upper carrier in the seats of the lower carrier, to provide stability for the stack of bottles.

2. The carrier defined in claim 1 wherein the spacing means provides openings by which the carrier may be grasped for carrying.

3. The carrier defined in claim 1 wherein the resilient means on each ring comprises a plurality of resilient tongues projecting upward and radially inward from the ring and having upper ends below the bottle seat.

4. The carrier defined in claim 3 wherein each ring is of such diameter that when a bottle is gripped by its neck by the set of tongues the ring may bear on the neck of the bottle.

5. The carrier defined in claim 1 for circular bottles wherein each bottle seat comprises a base and means on the base for laterally confining the bottom of a bottle.

6. The carrier defined in claim 5 wherein said confining means comprises a series of lugs extending up from the base arranged in a circle, the radially inner sides of the lugs being tapered outward and upward.

7. The carrier defined in claim 1 for circular bottles wherein each bottle seat includes a series of lugs arranged in a circle.

8. The carrier defined in claim 7 wherein the radially inner sides of the lugs are tapered outward and upward.

9. The carrier defined in claim 1 wherein said supporting members are legs extending downward from the respective bottle seat and spaced apart around the seat.

10. The carrier defined in claim 1 having struts joining the bottle gripper supporting means at their bottoms.

11. The carrier defined in claim 1 wherein the supporting members are so inclined and the ring is of such diameter as to permit stacking of one empty carrier on another with the gripper support means of one carrier extending through the central opening of and on the inner side of the support means of a second carrier, thereby enabling compact stacking of empty carriers.

12. The carrier defined in claim 10 having struts joining the gripper supporting means at their bottoms and wherein the bottle seats have slots in their upper sides aligned with the struts, whereby on stacking of two or more empty bottle carriers the struts on one carrier will be received in the slots in the carrier next below.

13. A carrier for bottles, each of which has a neck and a finish at the bottle mouth, adapted for carrying a plurality of bottles grouped in a predetermined array by the bottle necks with the bottles hanging down from the carrier, and enabling relatively stable stacking of bottles, said carrier comprising:

a plurality of bottle seats each adapted for the seating therein of the bottom of a bottle held by a carrier thereabove;

means for spacing the plurality of bottle seats in correspondence with said predetermined array;

bottle gripper supporting means beneath each seat, each supporting means extending down from the respective seat at the boundary of the seat and being centered with respect to the seat; and sets of bottle grippers, one set for each seat, each set being carried by a respective gripper supporting means at the lower end thereof, each set being adapted for upward entry of the upper end of the neck of a bottle therein and adapted releasably to grip the neck at the lower end of the finish for hanging of the bottle by the finish;

said gripper supporting means and said grippers being so dimensioned relative to the bottle finish that the mouth of a bottle carried by a set of grippers will not project above the respective seat;

whereby when a set of bottles gripped by a carrier is stacked upon another set of bottles gripped by a carrier, the bottles gripped by the upper carrier may be maintained substantially in vertical alignment with the bottles gripped by the lower carrier by seating of the bottles gripped by the upper carrier in the seats of the lower carrier, to provide stability for the stack of bottles;

the carrier being for circular bottles, each bottle seat comprising a base and means on the base for laterally confining the bottom of a bottle;

said confining means comprising a series of lugs extending up from the base arranged in a circle, the radially inner sides of the lugs being tapered outward and upward.

14. A carrier for bottles, each of which has a neck and a finish at the bottle mouth, adapted for carrying a plurality of bottles grouped in a predetermined array by the bottle necks with the bottles hanging down from the carrier, and enabling relatively stable stacking of bottles, said carrier comprising:

a plurality of bottle seats each adapted for the seating therein of the bottom of a bottle held by a carrier thereabove;

means for spacing the plurality of bottle seats in correspondence with said predetermined array;

bottle gripper supporting means beneath each seat, each supporting means extending down from the respective seat at the boundary of the seat and being centered with respect to the seat; and sets of bottle grippers, one set for each seat, each set being carried by a respective gripper supporting means at the lower end thereof, each set being adapted for upward entry of the upper end of the neck of a bottle therein and adapted releasably to grip the neck at the lower end of the finish for hanging of the bottle by the finish;

said gripper supporting means and said grippers being so dimensioned relative to the bottle finish that the mouth of a bottle carried by a set of grippers will not project above the respective seat;

whereby when a set of bottles gripped by a carrier is stacked upon another set of bottles gripped by a carrier, the bottles gripped by the upper carrier may be maintained substantially in vertical alignment with the bottles gripped by the lower carrier by seating of the bottles gripped by the upper carrier in the seats of the lower carrier, to provide stability for the stack of bottles;

the carrier being for circular bottles and each bottle seat including a series of lugs arranged in a circle.

15. The carrier defined in claim 14 wherein the radially inner sides of the lugs are tapered outward and upward.

16. A carrier for bottles, each of which has a neck and a finish at the bottle mouth, adapted for carrying a plurality of bottles grouped in a predetermined array by the bottle necks with the bottles hanging down from the carrier, and enabling relatively stable stacking of bottles, said carrier comprising:

a plurality of bottle seats each adapted for the seating therein of the bottom of a bottle held by a carrier thereabove;

means for spacing the plurality of bottle seats in correspondence with said predetermined array;

bottle gripper supporting means beneath each seat, each supporting means extending down from the respective seat at the boundary of the seat and being centered with respect to the seat; and sets of bottle grippers, one set for each seat, each set being carried by a respective gripper supporting means at the lower end thereof, each set being adapted for upward entry of the upper end of the neck of a bottle therein and adapted releasably to grip the neck at the lower end of the finish for hanging of the bottle by the finish;

said gripper supporting means and said grippers being so dimensioned relative to the bottle finish that the mouth of a bottle carried by a set of grippers will not project above the respective seat;

whereby when a set of bottles gripped by a carrier is stacked upon another set of bottles gripped by a carrier, the bottles gripped by the upper carrier may be maintained substantially in vertical alignment with the bottles gripped by the lower carrier by seating of the bottles gripped by the upper carrier in the seats of the lower carrier, to provide stability for the stack of bottles;

each bottle gripper supporting means including a plurality of legs extending downward from the respective bottle seat and spaced apart around the seat.

17. A carrier for bottles, each of which has a neck and a finish at the bottle mouth, adapted for carrying a plurality of bottles grouped in a predetermined array by the bottle necks with the bottles hanging down from the carrier, and enabling relatively stable stacking of bottles, said carrier comprising:

a plurality of bottle seats each adapted for the seating therein of the bottom of a bottle held by a carrier thereabove;

means for spacing the plurality of bottle seats in correspondence with said predetermined array;

bottle gripper supporting means beneath each seat, each supporting means extending down from the respective seat at the boundary of the seat and being centered with respect to the seat; and sets of bottle grippers, one set for each seat, each set being carried by a respective gripper supporting means at the lower end thereof, each set being adapted for upward entry of the upper end of the neck of a bottle therein and adapted releasably to grip the neck at the lower end of the finish for hanging of the bottle by the finish;

said gripper supporting means and said grippers being so dimensioned relative to the bottle finish that the mouth of a bottle carried by a set of grippers will not project above the respective seat;

whereby when a set of bottles gripped by a carrier is stacked upon another set of bottles gripped by a carrier, the bottles gripped by the upper carrier may be maintained substantially in vertical alignment with the bottles gripped by the lower carrier by seating of the bottles gripped by the upper carrier in the seats of the lower carrier, to provide stability for the stack of bottles;

each bottle seat having a central opening;

the bottle gripper support means being coned downward around the central opening to a diameter which permits stacking of one empty carrier on another with the gripper support means of one carrier extending through the central opening of and on the inner side of the support means of a second carrier, thereby enabling compact stacking of empty carriers.

18. A carrier for bottles, each of which has a neck and a finish at the bottle mouth, adapted for carrying a plurality of bottles grouped in a predetermined array by the bottle necks with the bottles hanging down from the carrier, and enabling relatively stable stacking of bottles, said carrier comprising:

a plurality of bottle seats each adapted for the seating therein of the bottom of a bottle held by a carrier thereabove;

means for spacing the plurality of bottle seats in correspondence with said predetermined array;

bottle gripper supporting means beneath each seat, each supporting means extending down from the respective seat at the boundary of the seat and being centered with respect to the seat; and sets of bottle grippers, one set for each seat, each set being carried by a respective gripper supporting means at the lower end thereof, each set being adapted for upward entry of the upper end of the neck of a bottle therein and adapted releasably to grip the neck at the lower end of the finish for hanging of the bottle by the finish;

said gripper supporting means and said grippers being so dimensioned relative to the bottle finish that the mouth of a bottle carried by a set of grippers will not project above the respective seat;

whereby when a set of bottles gripped by a carrier is stacked upon another set of bottles gripped by a carrier, the bottles gripped by the upper carrier may be maintained substantially in vertical alignment with the bottles gripped by the lower carrier by seating of the bottles gripped by the upper carrier in the seats of the lower carrier, to provide stability for the stack of bottles;

said carrier having struts joining the gripper supporting means at their bottoms;

the bottle seats having slots in their upper sides aligned with the struts, whereby on stacking of two or more empty bottle carriers the struts on one carrier will be received in the slots in the carrier next below.

19. A molded plastic carrier for bottles each having a neck and a finish at the bottle mouth, adapted for carrying a plurality of bottles in a predetermined array by the bottle necks with the bottles hanging down from the carrier, said carrier having:

a handle portion, a plurality of bottle gripper means molded integrally with the handle portion, each bottle gripper means comprising a ring, and resilient means extending upwardly from the ring and inclined inwardly for gripping the neck of a bottle at the lower end of the bottle finish for hanging of the bottle by the finish, said bottle gripper means, including the ring and said resilient means which extends upwardly and inwardly from the ring, being so dimensioned relative to a bottle to be carried that with said resilient means gripping the bottle neck at the lower end of the bottle finish, said ring is in surrounding engagement with the bottle in a plane below the lower end of the finish so as to tend to stabilize the bottle against swinging or tilting relative to the carrier.

* * * * *